US005836540A

United States Patent [19]

Romer et al.

[11] Patent Number: 5,836,540

[45] Date of Patent: Nov. 17, 1998

[54] PROJECTILE HAVING AN APPARATUS FOR FLIGHT-PATH CORRECTION

[75] Inventors: Rudolf Romer, Kaarst; Gerd Wollmann, Oberhausen, both of Germany

[73] Assignee: Rheinmetall W & M GmbH, Unterluss, Germany

[21] Appl. No.: 477,121

[22] Filed: Mar. 24, 1995

[30] Foreign Application Priority Data

Mar. 25, 1994 [DE] Germany ..... 44 10 326.3

[51] Int. Cl.[6] ..... F41G 7/00

[52] U.S. Cl. ..... 244/3.16

[58] Field of Search ..... 244/3.21, 3.22, 244/3.16; 102/384, 213

[56] References Cited

U.S. PATENT DOCUMENTS

| | | | |
|---|---|---|---|
| 4,347,996 | 9/1982 | Grosso | 244/3.16 |
| 4,408,735 | 10/1983 | Metz | 244/3.16 |
| 4,568,040 | 2/1986 | Metz | 102/384 |
| 4,674,408 | 6/1987 | Stessen | 102/384 |
| 4,878,433 | 11/1989 | Pirolli | 102/384 |
| 4,898,340 | 2/1990 | Kilger et al. | 24/3.11 |
| 5,054,712 | 10/1991 | Bar et al. | 244/3.22 |
| 5,114,094 | 5/1992 | Harris | 244/3.22 |
| 5,129,604 | 7/1992 | Bagley | 244/3.22 |
| 5,238,204 | 8/1993 | Metz | 244/3.22 |
| 5,341,743 | 8/1994 | Redaud | 102/384 |
| 5,386,951 | 2/1995 | Gaywood | 244/3.22 |
| 5,478,028 | 12/1995 | Snyder | 244/3.22 |

FOREIGN PATENT DOCUMENTS

| | | | |
|---|---|---|---|
| 0 028 966 | 5/1981 | European Pat. Off. . | |
| 2556086 | 6/1985 | France | 102/213 |
| 108791 | 8/1966 | Germany . | |
| 22 64243 C2 | 1/1985 | Germany . | |
| 3802551 | 8/1989 | Germany | 244/3.22 |
| 25 43 606 A1 | 4/1997 | Germany . | |

*Primary Examiner*—Charles Jordan
*Assistant Examiner*—Theresa M. Wesson
*Attorney, Agent, or Firm*—Spencer & Frank

[57] ABSTRACT

A projectile having a longitudinal axis, a sensor disposed in the substantially pointed front end of the projectile for detecting a respective target, and electronics connected to the output of the sensor for igniting a correction charge to effect a correction of the flight path of the projectile by a predetermined angle ($\delta_0$). In order to install the apparatus for flight-path correction into the respective projectile completely and in a space-saving manner, so that, unlike in known projectiles, corresponding evaluation and signal-transmission units in the respective weapon carrier can be omitted and complicated gyroscopic systems in the projectile can be omitted, the sensor determines the angle ($\delta$) between the longitudinal axis of the projectile and the line (target line) connecting the projectile and the target, and when an angle ($\delta_0$) is reached that is identical in size/magnitude to the deviation caused by the respective correction charge, the electronics ignite this charge.

2 Claims, 1 Drawing Sheet

PROJECTILE HAVING AN APPARATUS FOR FLIGHT-PATH CORRECTION

REFERENCE TO RELATED APPLICATIONS

This application claims the priority of German application Serial No. P 44 10 326.3, filed Mar. 25, 1994, which is incorporated herein by reference.

BACKGROUND OF THE INVENTION

The invention relates to a projectile having a longitudinal axis, a sensor disposed in the substantially pointed front end of the projectile for detecting a respective target, and electronics connected to the output of the sensor for igniting a flight correction charge disposed on the projectile to effect a correction of the flight path of the projectile by a predetermined angle ($\delta_0$).

Projectiles of the above type are known from, for On example, DE 22 64 243 C2 or DE 25 43 606. To increase hit probability, such projectiles have an apparatus for flight-path correction wherein as it becomes necessary, a pulse perpendicular to the longitudinal axis of the projectile and aimed at the center of gravity is produced. The pulses are generated with the aid of mass particles accelerated by a detonating explosive. The projectiles are laser-controlled by the corresponding weapon carrier, and have correspondingly complex computer electronics and a signal-transmission apparatus.

The greatest disadvantage of these known projectiles is the relatively high construction expenditure for the projectiles and of the corresponding weapon carriers.

SUMMARY OF THE INVENTION

It is the object of the invention to modify the projectiles of the type mentioned at the outset in such a way that the apparatus for flight-path correction can be installed or built completely into the projectile, and in a space-saving manner, so that corresponding evaluation and signal-transmission units in the weapon carrier can be omitted, and complicated gyroscopic systems in the projectile can be omitted.

The above object is generally achieved according to the invention, a projectile having a longitudinal axis and a substantially pointed front end, at least one flight correction charge disposed on the projectile for effecting a correction of the flight path of the projectile by a predetermined angle ($\delta_0$) when ignited, a sensor disposed in said front end of said projectile for detecting a respective target and for determining an angle ($\delta$) between the longitudinal axis of the projectile and a line (target line) connecting the projectile and the target, and electronics, responsive to an output from the sensor, for igniting the flight correction charge when the angle ($\delta$) determined by the sensor is identical in magnitude to a flight deviation caused by the respective flight correction charge.

According to the preferred embodiment of the invention, the sensor, for determination of the angle ($\delta$) between the longitudinal axis of the projectile and the target line, includes an optoelectronic sensor element on which the respective target is represented, and said sensor electronically measures the angle with respect to the longitudinal axis of the projectile.

The invention is essentially based on the concept of monitoring the angle $\delta$ between the longitudinal axis of the projectile and the respective line connecting or extending between the projectile and the target (target line) using a sensor that is known per se. As soon as this angle $\delta$ corresponds to a predetermined value $\delta_0$, which is identical in size/magnitude to the flight-path deviation of the projectile caused by a corresponding correction charge, the corresponding charge is ignited. In fin-stabilized projectiles, the sensor essentially comprises an optoelectronic element on which the target is represented or imaged. Both the angle $\delta$ and the necessary direction of the correction charge to be ignited can be taken from this image.

In the case of spin-stabilized projectiles, the roll angle of the projectile must additionally be taken into consideration, so a roll-angle sensor is also to be integrated into the projectile.

Because of the simple construction of the apparatus of the invention for flight-path correction, this apparatus is not only suited for artillery and tank projectiles, but also, and particularly, for small-caliber projectiles, such as those that are conventionally used in machine guns and have an essentially prolate flat flight path.

Further details and advantages of the invention ensue from the following embodiments explained by way of the drawing figures.

DETAILED DESCRIPTION OF THE PREFERRED EMBODIMENT

Figure 1:
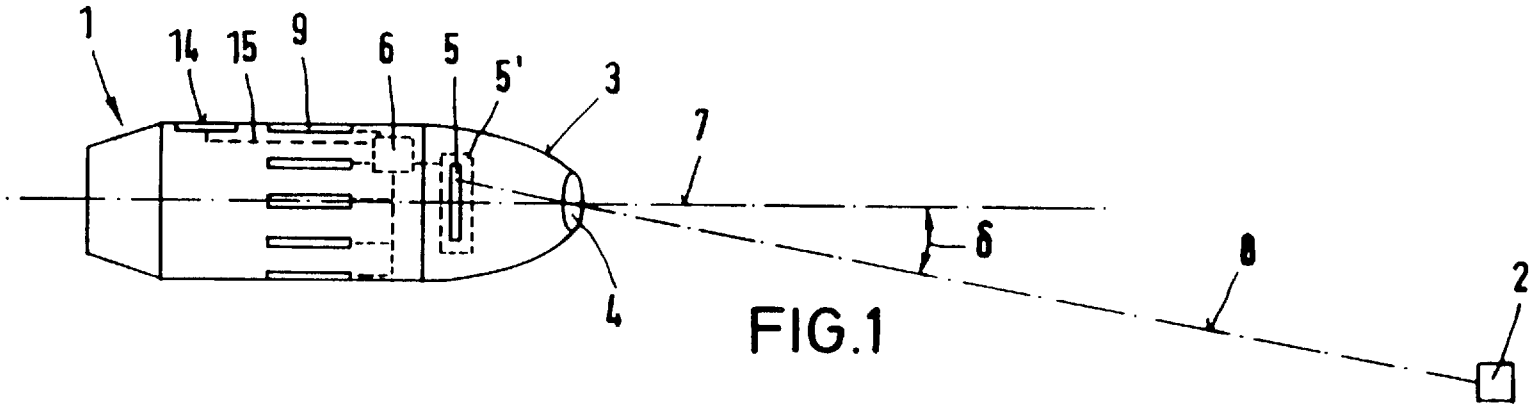
FIG. 1 is a schematic representation of a projectile according to the invention during flight.

Referring now to FIG. 1, there is shown a projectile 1 and a target 2 to be hit by the projectile 1. The projectile 1 has, in a convention manner, a substantially pointed or ogival front end 3, and a lens 4 is disposed therein. This lens 4 focus an image of the target on an optoelectronic element 5 of a corresponding sensor 5' disposed within the front end of the projectile. Connected to the output of sensor 5' is an ignition electronic circuit 6 for, in a conventional manner, igniting an appropriate one of a plurality of flight correction charges 9 disposed about the circumference of the projectile 1, likewise in a conventional manner. These charges 9, when ignited cause an angular deviation in the flight path of the projectile 1 by a given angle ($\delta_0$).

The corresponding image of the target 2 formed on the element 5 is scanned by the optoelectronic sensor 5', and the angle $\delta$ between the longitudinal axis 7 of the projectile 1 and the line 8 (target line) connecting, or extending between, the projectile 1 and the target 2 is determined. As soon as the determined angle $\delta$ corresponds to the predetermined angle value $\delta_0$, the ignition electronics 6 generates an ignition signal that then ignites the appropriate correction charge 9 disposed at the circumference of the projectile 1, so that the projectile 1 rotates in the direction of the target 2 until the angle $\delta \approx 0$.

Figure 2:
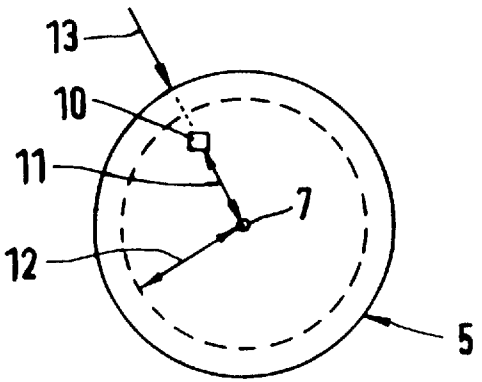
FIG. 2 is a schematic top view of an optoelectronic element in the projectile according to the invention for determining the angle between the longitudinal axis of the projectile and the target line.

FIG. 2 shows a top view of the optoelectronic element 5. In this instance the longitudinal axis 7 of the projectile 1 may, and preferably does, pass through the center point of the element 5. The image of the target 2 (FIG. 1) is indicated by reference numeral 10. As can be readily be seen in FIG. 2, the distance 11 between the longitudinal axis 7 and the image 10 of the target 2 is a measure for the angle $\delta$ and thus can be taken directly from the scanning data of the sensing element 5. In FIG. 2 the distance 12 corresponds to the threshold value angle $\delta_0$. For a fin-stabilized projectile, the direction of the necessary correction pulse, which is indicated by arrow 13 in FIG. 2, also directly results from the determination of distance 11 of the position of the image 10 on element 5.

In a spin-stabilized projectile, and provided that the sensor element 5 is permanently connected to the projectile 1, instead of a single image of the target 2 on the element 5, the image of the target 2 on the optoelectronic element 5 follows a correspondingly wider circle around the axis 7 (not shown). The distance of this circle from the longitudinal axis 7 again corresponds to the angle δ. However, in this case, a determination of the roll position of the projectile is necessary for precise determination of the correction charge 9 to be ignited. This position is determined in a manner known per se by mounting a roll-position sensor 14 (see FIG. 1), and, via a line 15, linking the corresponding measured values with the measured values for the angle δ etc. in the ignition electronics 6.

The invention now being fully described, it will be apparent to one of ordinary skill in the art that any changes and modifications can be made thereto without departing from the spirit or scope of the invention as set forth herein.

What is claimed:

1. A projectile having a longitudinal axis and a substantially pointed front end, at least one flight correction charge disposed on the projectile for effecting a correction of the flight path of the projectile by a predetermined angle ($\delta_0$) when ignited, a sensor disposed in said front end of said projectile for detecting a respective target and for measuring an angle (δ) between the longitudinal axis of the projectile and a line connecting the projectile and the target, and electronics, responsive to an output from said sensor, for causing ignition of said flight correction charge when said angle (δ) measured by said sensor is identical in magnitude to a flight path correction of said predetermined angle ($\delta_0$) caused by the respective flight correction charge.

2. A projectile as defined in claim 1, wherein said sensor, for determination of the angle (δ) between the longitudinal axis of the projectile and the target line, includes an optoelectronic sensor element on which the respective target is represented, and said sensor electronically measures the angle with respect to the longitudinal axis of the projectile.

* * * * *